US005157794A

United States Patent [19]

Kamata

[11] Patent Number: 5,157,794

[45] Date of Patent: Oct. 27, 1992

[54] HELMET

[75] Inventor: Fitaro Kamata, Tokyo, Japan

[73] Assignee: Shoei Kako Kabushiki Kaisha, Tokyo, Japan

[21] Appl. No.: 680,967

[22] Filed: Apr. 5, 1991

[30] Foreign Application Priority Data

Oct. 3, 1990 [JP] Japan ..... 2-104234[U]

[51] Int. Cl.[5] ..... A42B 3/02

[52] U.S. Cl. ..... 2/424

[58] Field of Search ..... 2/424, 6, 9, 10, 410, 2/425, 171.3, 5, 12

[56] References Cited

U.S. PATENT DOCUMENTS

| | | | |
|---|---|---|---|
| 3,315,272 | 4/1967 | Olt et al. | 2/424 |
| 3,721,994 | 3/1973 | De Simone et al. | 2/10 X |
| 4,519,099 | 5/1985 | Kamiya et al. | 2/424 |
| 5,012,528 | 5/1991 | Pernicka et al. | 2/424 |

FOREIGN PATENT DOCUMENTS

| | | | |
|---|---|---|---|
| 2532528 | 3/1984 | France | 2/424 |
| 2595920 | 9/1987 | France | 2/425 |
| 64-26336 | 2/1989 | Japan . | |

*Primary Examiner*—Peter Nerbun
*Attorney, Agent, or Firm*—Armstrong & Kubovcik

[57] ABSTRACT

A helmet includes a cap body, a shield plate pivotally mounted at left and right opposite ends on the cap body for pivotal movement between a closed position for closing the front face of the cap body and an opened position for opening the front face, and a visor which is attached at its left and right opposite ends to the cap body, a tip end of the visor being located at a position forwardly above the opening in the front face, thereby defining a housing chamber between the visor and the cap body for receiving the shield plate at the opening position.

8 Claims, 8 Drawing Sheets

HELMET

BACKGROUND OF THE INVENTION

1. Field of the Invention

The field of the present invention is helmets principally used by a motorcycle rider or the like, and more particularly, improvements in helmets of the type comprising a cap body and a shield plate pivotally mounted at left and right opposite ends on the cap body for pivotal movement between a closed position in which an opening in a front face of the cap body is closed and an opened position in which the opening in the front face is opened.

2. Description of the Prior Art

There is a conventionally known helmet of this type, for example, as disclosed in Japanese Utility Model Application Laid-open No. 115033/88.

In the prior art helmet, however, even when the shield plate is in a non-service opened position, it is exposed to the outside of the cap body and hence, there is a possibility that the shield plate may be damaged by contact with any external object.

As a helmet of such type, there is also known one comprising closure retaining members attached respectively to outer surfaces of opposite sides of the cap body for retaining the shield plate at the closed position. Each retaining member clamps corresponding one of side edges of the shield plate (see Japanese Utility Model Application Laid-open No. 87123/89).

In the above prior art helmet, however, each closure retaining member cannot be shifted in opening and closing directions of the shield plate. This results in a disadvantage that when it is required to adjust the closed position of the shield plate with relation to the opening in the front face of the cap body. The adjustment cannot be effected.

Further, there is also known a conventional helmet of such type, comprising a visor detachably pivotally mounted on the cap body with a front edge projecting forwardly from the cap body, and an adjusting means provided between the cap body and the visor for adjusting the mounting position of the visor in a longitudinal or front and rear direction of the cap body. In this case, the adjusting means is formed to have a body integrally provided on the visor of the helmet and fixed to the cap body by a fixing element (see Japanese Utility Model Application Laid-open No. 53340/89).

The adjusting means is required for changing the mounting position of the visor in the longitudinal direction of the cap body to deal with flapping of the visor by travelling wind, shading of the sunlight, insurance of wide view and the like.

In general, the visor and cap body are liable to be soiled. When the inner surface of the visor, the front wall of the cap body covered by the visor or the like is to be cleaned, the visor is removed from the cap body, because it is difficult to clean the front wall or the like, if the visor remains attached to the cap body. In the above prior art helmet, however, the adjusting means must be also removed together with the visor from the cap body, additionally, there is no means for positioning the fixing element on the body. Accordingly, after cleaning, the mounting position of the visor must be adjusted once again in reattachment of the visor.

SUMMARY OF THE INVENTION

It is an object of the present invention to provide a helmet of the above-described type, wherein the shield plate in the opened position can be protected from contact with an external object.

To achieve the above object, according to the present invention, there is provided a helmet comprising a cap body and a shield plate pivotally mounted at left and right opposite ends thereof on the cap body for pivotal movement between a closed position in which an opening in a front face of the cap body is closed and an opened position in which the opening in the front face is opened, wherein the helmet further includes a visor which is attached at left and right opposite ends thereof to the cap body, a tip end of the visor located at a position forwardly above the opening, a housing chamber being defined between the visor and the cap body for receiving the shield plate when the shield plate is pivotally moved to the opened position.

With the above construction, contact of the shield plate with an external object can be avoided by housing the shield plate in the housing chamber and moreover, the visor serves also as a protecting cover and eliminates the need of an exclusive protecting cover, thus leading to a simplified structure and a reduction in manufacturing cost.

It is another object of the present invention to provide a helmet of the above-described type, wherein the adjustment of the closed position of the shield plate can be easily conducted.

To achieve the above object, according to the present invention, there is provided a helmet further including a closure retaining means provided between the cap body and the shield plate for retaining the shield plate at the closed position, the closure retaining means including a first engaging element mounted on the cap body for shifting in the longitudinal direction of the cap body, and a second engaging element mounted on the shield plate and adapted to be engaging with the first engage element, wherein a fixing element is provided for fixing the first engaging element to the cap body at any position within a region of shifting of the first engaging element.

With the above construction, the shield plate can be reliably retained at the closed position by engagement of the first and second engaging elements with each other.

In adjusting the closed position of the shield plate, the first engaging element with which the second engage element engages may be shifted and then fixed to the cap body by the fixing element. Therefore, the adjustment of the closed position of the shield plate can be easily conducted.

It is further object of the present invention to provide a helmet of the above-described type, wherein in adjusting the mounting position of the visor. The adjustment can be easily conducted, and when the visor is to be attached again to the cap body after cleaning of the visor or the like, the visor can be placed at the same mounting position as before removal.

To achieve the above object, according to the present invention, there is provided a helmet wherein the visor is attachable to and detachable from the cap body, and the helmet further includes an adjusting means between the cap body and the visor for adjusting the mounting position of the visor in the longitudinal direction of the cap body, the adjusting means including a body located on an outer surface of the cap body for shifting in the longitudinal direction of the cap body, and a fixing element for fixing the body of the adjusting means to the cap body at any position within a region of shifting of the body, the body is provided with a stopper adapted to be engaged with the visor to restrain the movement of the visor in the longitudinal direction of the cap body.

With the above construction, if the fixing effected by the fixing element is released and the body is shifted, the mounting position of the visor in the longitudinal direction of the cap body can be easily adjusted, and the mounting position after being adjusted is held by the fixing element.

Even if the visor is removed from the cap body for cleaning or the like, the adjusting means is left on the cap body. Therefore, when the visor is to be attached to the cap body again, the visor can be placed simply and reliably at the same mounting position as before removal by bringing the stopper into engagement with the visor.

The above and other objects, features and advantages of the invention will become apparent from a reading of the following description of the preferred embodiment, taken in conjunction with the accompanying drawings.

DESCRIPTION OF THE PREFERRED EMBODIMENTS

Figure 1:
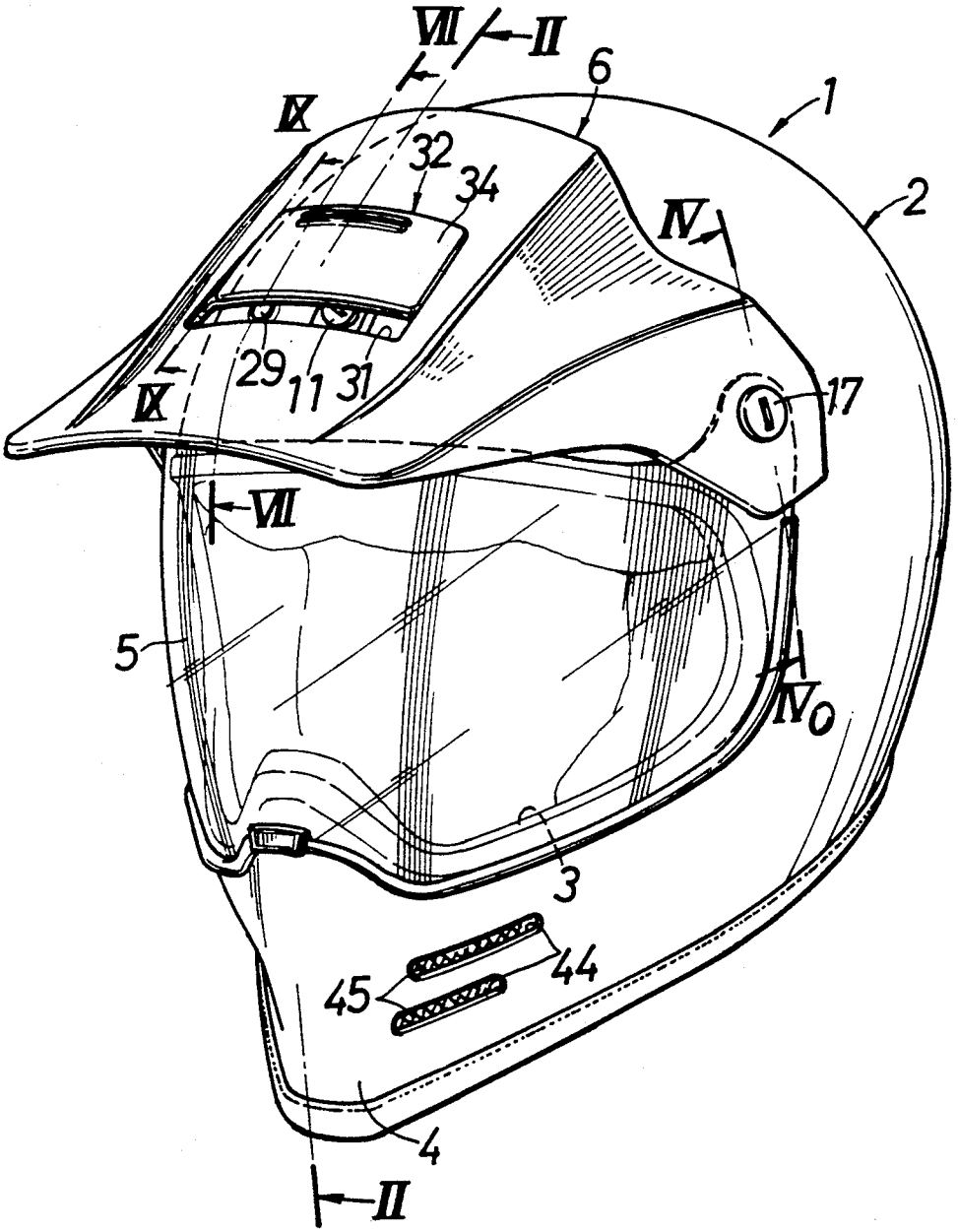
FIG. 1 is a perspective view of a helmet with a shutter opened and a shield plate held at a closed position.
Figure 2:
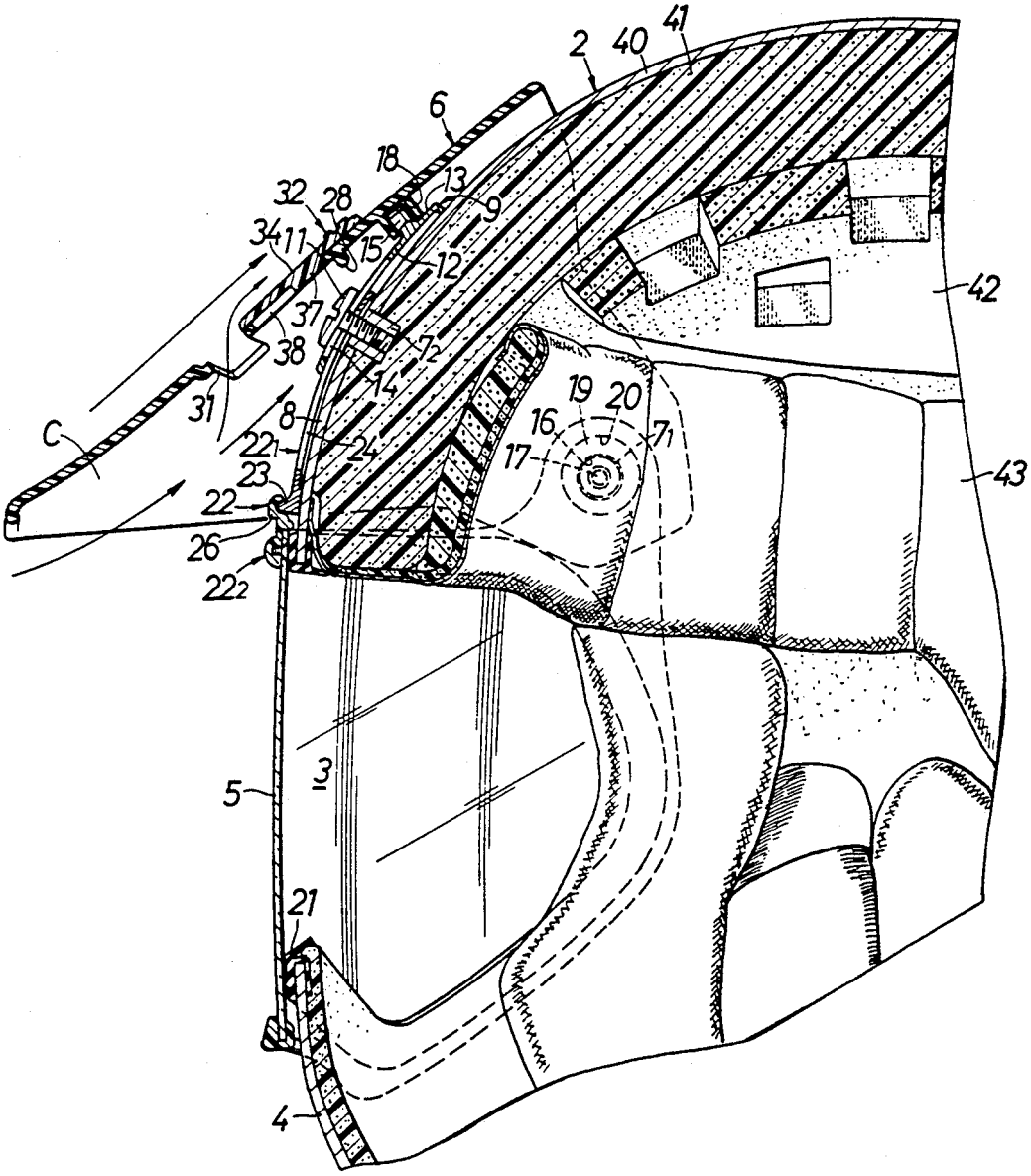
FIG. 2 is a sectional view taken along a line II—II in FIG. 1.
Figure 3:
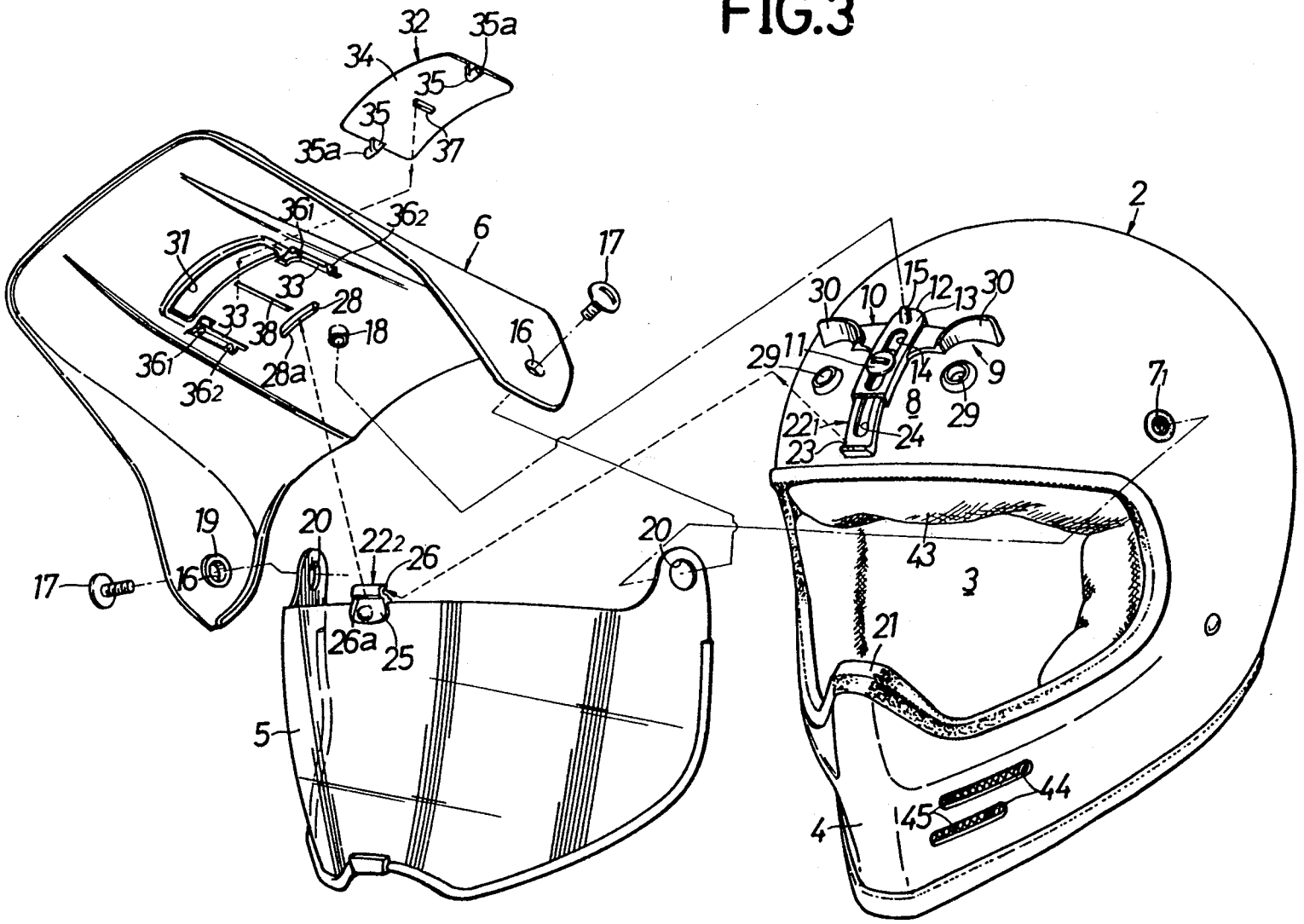
FIG. 3 is an exploded perspective view of the helmet.

Referring to FIGS. 1 to 3, a helmet 1 for riding a vehicle is shown to have a cap body 2 formed into a full-face type having a chin cover portion 4 immediately below an opening 3 in a front face.

A shield plate 5 and a visor 6 are detachably mounted on the cap body 2.

The shield plate 5 and the visor 6 are made of synthetic resin, and the mounting structure thereof to the cap body 2 will be described below.

Figure 4:
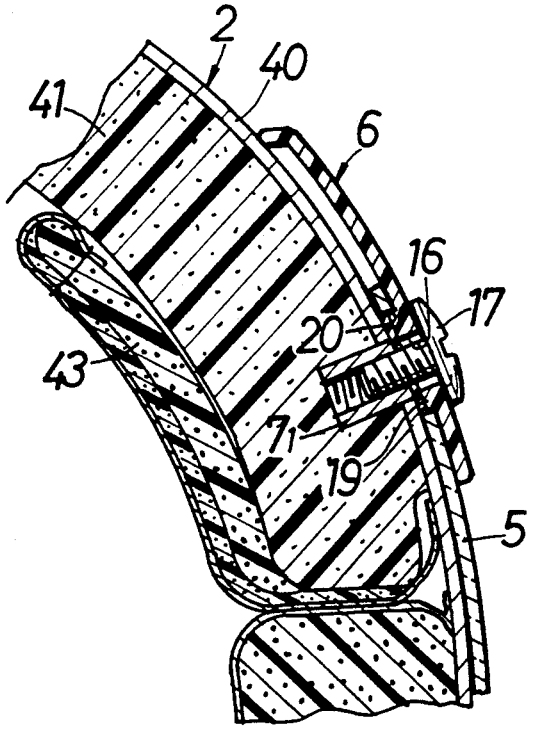
FIG. 4 is a sectional view taken along a line IV—IV in FIG. 1.

As clearly shown in FIGS. 3 and 4, a nut $7_1$ is embedded in each of left and right sidewalls of the cap body 2, and at a laterally central portion of a front wall 8 of the cap body 2, there is provided with an adjusting means 9 for adjusting the mounting position of the visor 6 in a longitudinal or front and rear direction of the cap body.

The adjusting means 9 is comprised of a body 10 of a substantially T-shape as viewed in a plane, and a machine screw 11 serving as a fixing element threadedly engaged in a nut $7_2$ of the cap body 2 to fix the body 10 to the cap body 2. The body 10 includes a channeled main portion 12. An elongated hole 14 is provided in a ceiling wall 13 of the main portion 12 so as to extend longitudinally of the cap body for receiving the machine screw 11 therethrough. A projecting stopper 15 is provided on an outer surface of the ceiling wall 13 rearwardly of the elongated hole 14. Thus, the body 10 is shiftable longitudinally of the cap body by loosening the machine screw 11 and is capable of being fixed, by the machine screw 11, to the cap body at any position in a region of shifting thereof limited by the elongated hole 14.

A mounting hole 16 is provided in each of left and right opposite ends of the visor 6, and a machine screw 17 passes through each of the mounting holes 16 and is threadedly engaged into the nut $7_1$. A cylindrical support 18 is projectingly mounted on an inner surface of the visor 6 at a laterally central portion thereof closer to a rear edge and is engaged (fitted over in the illustrated embodiment) with the stopper 15.

In this manner, the visor 6 is attached to the cap body 2 so as to project forwardly of the opening 3 in the front face along a line tangent to an outer surface of the cap body 2. The movement of the visor 6 in the longitudinal direction of the cap body 2 is limited by the stopper 15.

If the mounting position of the visor 6 in the longitudinal direction of the cap body 2 is desired to be adjusted in order to deal with flapping by wind, shading from the sunlight, insurance of wide view and the like, the machine screw 11 may be loosened to shift the body 10. This ensures the mounting position of the visor 6 in the longitudinal direction of the cap body being easily adjusted. The mounting position after adjustment is held by threadedly tightening the machine screw 11 into the nut $7_2$.

Even if the visor 6 is removed from the cap body 2 for the purpose of cleaning of the visor 6 and the cap body 2 or for the other purpose, the adjusting means 9 is left on the cap body 2. Therefore, when the visor 6 is to be attached again to the cap body 2, the visor 6 can be disposed at the same mounting position as before removal by fitting the stopper 15 into the cylindrical support 18.

An inner surface of the visor 6 is formed with bosses 19 each surrounding corresponding one of mounting holes 16. Each of the bosses 19 is rotatably fitted in corresponding one of support holes 20 made in left and right opposite ends of the shield plate 5. This ensures that the shield plate 5 can be pivotally moved about pivots provided by the bosses 19 between a closed position in which the opening 3 in the front face is closed and an opened position in which the opening 3 in the front face is opened. When in the closed position, the shield plate 5 is in close contact with a seal rubber 21 mounted around a peripheral edge of the opening 3 in the front face.

A closure retaining means 22 is mounted in the following manner between the cap body 2 and the shield plate 5 to retain the shield plate 5 at the closed position and is comprised of a first $22_1$ and a second engaging element $22_2$.

The first engaging element $22_1$ is slidably fitted on the main portion 12 of the adjusting means 9 from its front end side and includes an engaging projection 23 at a front end thereof. In the first engaging element $22_1$, the machine screw 11 in the adjusting means 9 is inserted as a fixing element into an elongated hole 24 extending in the longitudinal direction of the cap body. This ensures that the first engaging element $22_1$ can be shifted in the longitudinal direction of the cap body by loosening the machine screw 11. The first engaging element $22_1$ is fixed, together with the main portion 12, to the cap body 2 through the machine screw 11 at any position within a region of shifting limited by the elongated hole 24 by utilizing the deflection of the main portion 12 in the adjusting means 9.

The body 10 of the adjusting means 9 and the first engaging element $22_1$ can easily be fixed in a fitted relation to each other by the single machine screw 11 in this manner, and the relative rotation between the body 10 and the first engaging element $22_1$ about the machine screw 11 is reliably prevented by fitting the stopper 15 into the cylindrical support 18.

The second engaging element $22_2$ is attached to an upper edge of the shield plate 5 at its laterally central portion and includes a mounting portion 25 extending along the shield plate 5, and a U-shaped engaging pawl 26 provided on the mounting portion 25 to project from the upper edge of the shield plate 5. The engaging pawl 26 corresponds to the engage projection 23 of the first engaging element $22_1$.

In the above construction, the shield plate 5 can be held at the closed position by bringing the engaging pawl 26 of the second engaging element $22_2$ into engagement with the engage projection 23 of the first engaging element $22_1$.

The engagement and disengagement between the engaging projection 23 and the engaging pawl 26 can be smoothly carried out through the aid of the elasticity of the shield plate 5. In this case, because the second engaging element $22_2$ is located at a position remotest from the two mounting positions of the shield plate 5 on the cap body 2, the effective utilization of the elasticity of the shield plate 5 ensures that the second engaging element $22_2$ exhibits a larger engaging force, thereby reliably maintaining the closed position of the shield plate 5.

If the closed position of the shield plate 5 is desired to be adjusted, the machine screw 11 may be loosened and with the two engaging elements $22_1$ and $22_2$ engaged, the first engaging element $22_1$ may be shifted and then fixed to the cap body by the machine screw 11.

Figure 5:
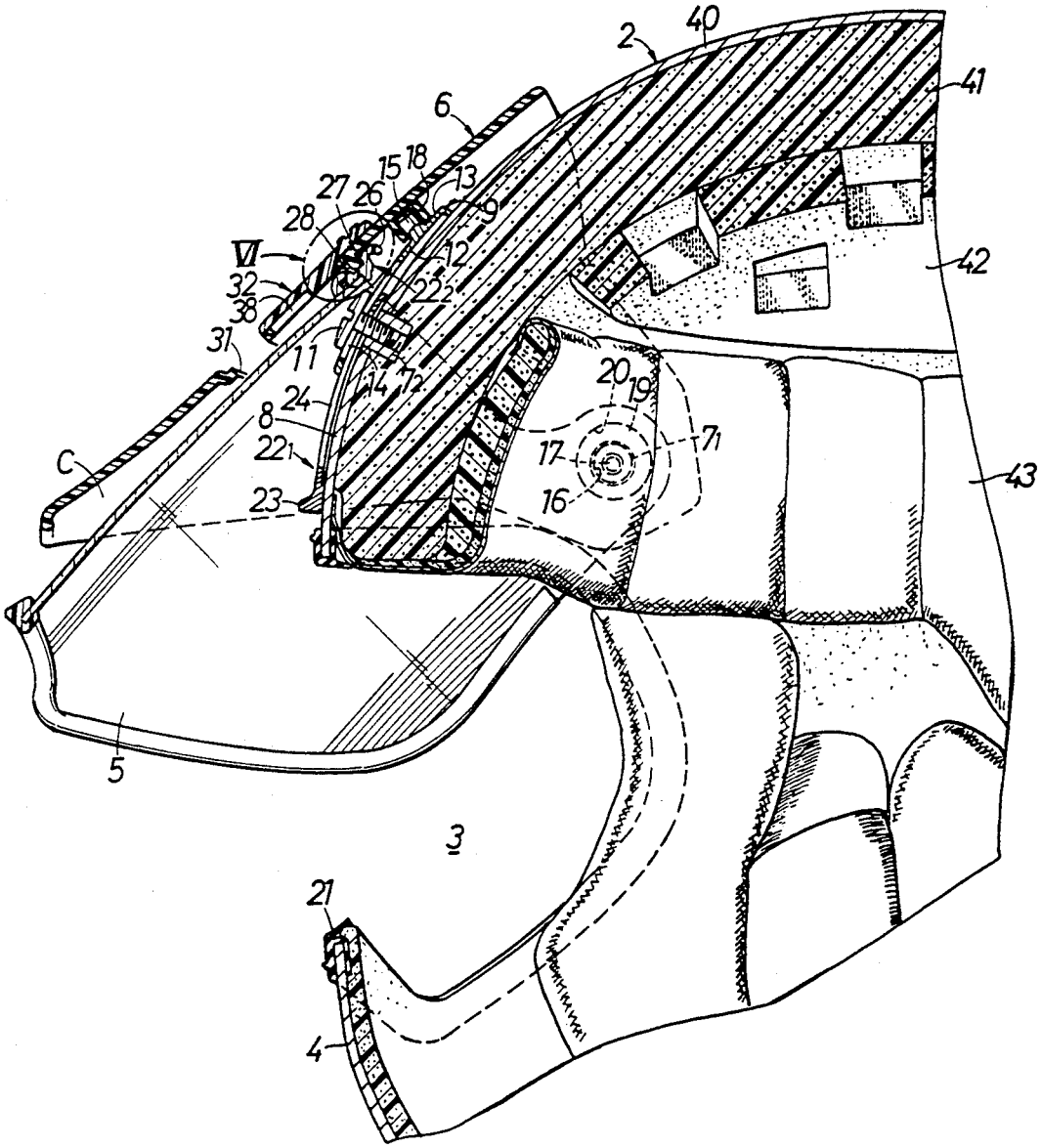
FIG. 5 is a sectional view similar to FIG. 2, but showing the shield plate held at an opened position.

By attaching the visor 6 to the cap body 2 in the above manner, a tip end of the visor 6 projects above the opening 3 in the front face and thus forwardly from the position opposing the front wall 8 of the cap body 2 thereby defining a housing chamber C between the visor 6 and the front wall 8, as clearly shown in FIG. 5, so that the shield plate 5 at the opened position is received or housed in the housing chamber C.

In this housed state of the shield plate 5, the visor 6 serves as a protecting cover for the shield plate 5, and this makes it possible to avoid the contact of the shield plate 5 with an external object.

As clearly shown in FIGS. 2 and 5, a housed-state retaining means 27 is provided between the visor 6 and the laterally central portion of the shield plate 5 for retaining the shield plate 5 housed. The housed-state retaining means 27 is comprised of an engaging projection 28 mounted on the inner surface of the visor 6 at the laterally central portion thereof forwardly of the cylindrical support 18, and the engaging pawl 26 of the second engage element $22_2$ mounted on the shield plate 5.

Figure 6:
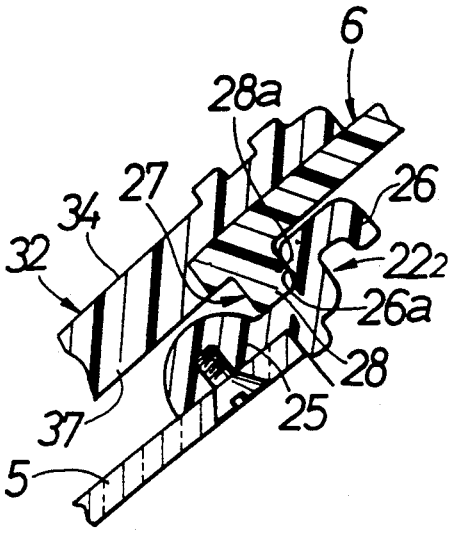
FIG. 6 is an enlarged view of a portion indicated by an arrow VI in FIG. 5.

As clearly shown in FIGS. 5 and 6, in the housed state of the shield plate 5, the engaging pawl 26 of the shield plate 5 rides climbs over the engaging projection 28 of the visor 6, so that an engage surface **26*a* of the engaging pawl 26 which is closer to the mounting portion 25 is engaged with an engaging surface 28*a* of the engage projection 28 which is closer to the cylindrical support 18**.

The engagement and disengagement between the engaging projection 28 and the engaging pawl 26 are achieved by utilizing the elasticity of at least one, e.g., both in the illustrated embodiment, of the shield plate 5 and the visor 6. In this case, the engaging projection 28 and the engaging pawl 26 are located at positions remotest from the mounting positions of the visor 6 and the shield plate 5 on the cap body 2 and therefore, the effective utilization of the elasticity of the visor 6 and the shield plate 5 ensures that the engaging projection 28 and the engage pawl 26 exhibit larger engaging forces, which makes it possible to reliably retain the shield plate 5 housed.

Figure 7:
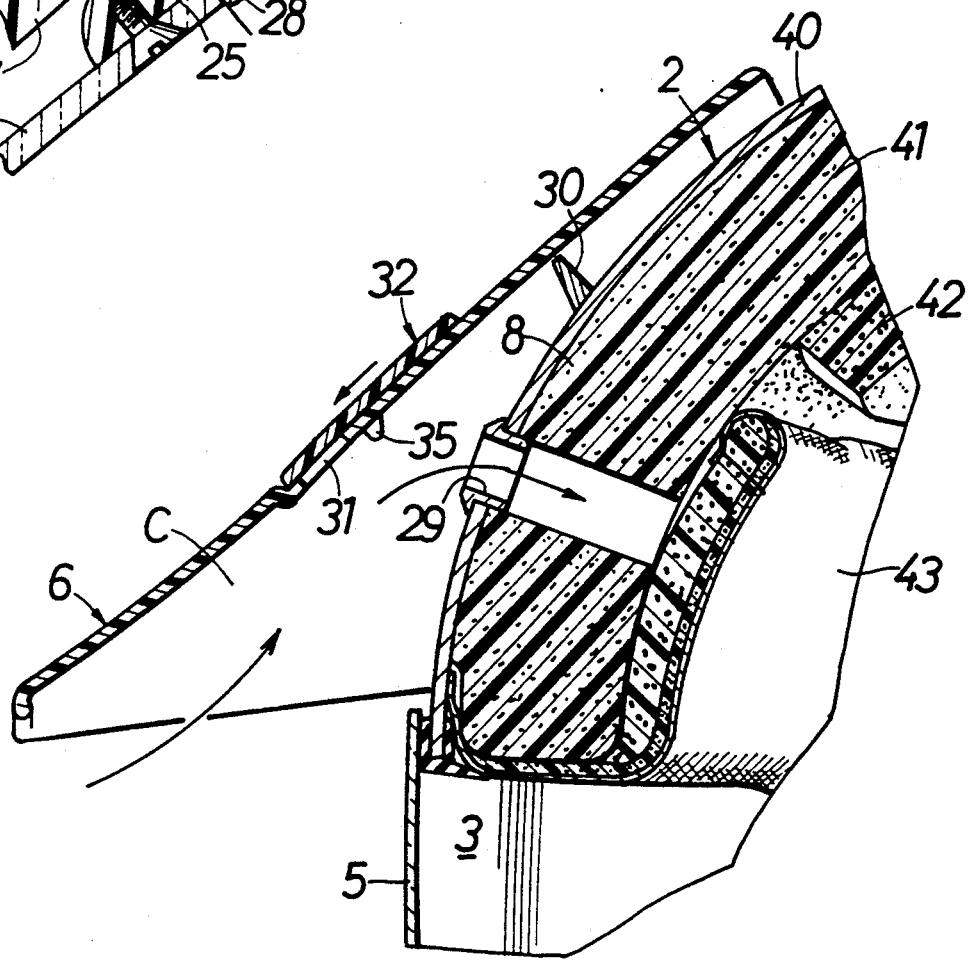
FIG. 7 is a sectional view taken along a line VII—VII in FIG. 1, but showing the shutter as being closed.

As clearly shown in FIGS. 2, 3 and 7, the housing chamber C also serves as travelling-wind flow-in space (which will be identified by the same reference character as the housing chamber C for convenience, hereinafter). In this case, a rear end of the travelling-wind flow-in space C is opened due to fitting of the stopper 15 in the cylindrical support 18 and hence, if a rider wearing the helmet 1 drives a motorcycle, the travelling wind flowing into the space C flows therefrom rearwardly of the visor 6, which makes it possible to prevent the visor 6 from being flapped by the travelling wind even during travelling of the motorcycle at higher speed.

On opposite sides of the main portion 12 of the adjusting means 9, the front wall 8 of the cap body 2 is provided with two air intake holes 29 leading to the travelling-wind flow-in space C. An inlet of each of the air intake holes 29 is opened at an outer surface of the front wall 8, and an outlet of each air intake hole 29 is opened at an inner surface of the front wall 8. The body 10 has a guide wall 30 raised along an upper half peripheral edge in the inlet of each air intake hole 29.

An escape opening 31 is formed into a laterally long rectangular shape in the visor 6 forwardly of the engaging projection 28 for permitting the travelling wind to escape therethrough into the travelling-wind flow-in space C, and a shutter 32 of synthetic resin is mounted on the visor 6 for opening and closing the escape opening 31.

The mounting structure of the shutter 32 on the visor 6 will be described below.

Figure 8:
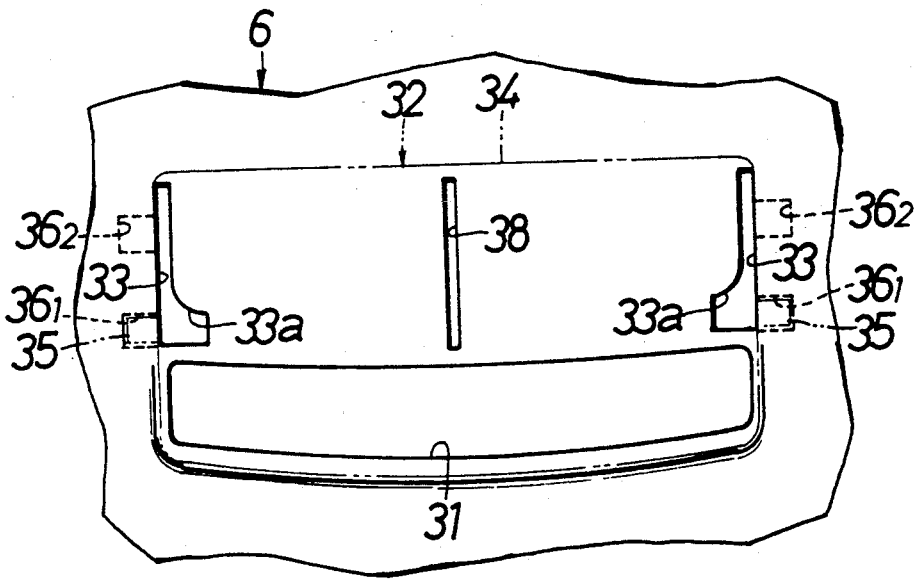
FIG. 8 is a plan view of an essential portion of a visor.

As clearly shown in FIGS. 3 and 8, a pair of elongated holes 33 are provided in parallel in the visor 6 to extend rearwardly from near the left and right opposite ends of the escape opening 31, and they have front ends which are formed into wider portions **33*a* by notching opposed inner edges of the elongated holes 33. A flat plate portion 34 of the shutter 32 has a size sufficient to completely close the escape opening 31 and is placed on the outer surface of the visor 6. A pair of support legs 35 are provided on a lower surface of the flat plate portion 34 at its left and right opposite side edges and are slidably inserted through the elongated holes 33, respectively. The support legs 35 are hook-shaped with their folded ends 35*a* directed outwardly. Each of the folded ends 35*a* abuts against a lower face of an outer edge of each elongated hole 33. This ensures that each support leg 35 is held in the visor 6** so that it cannot slip out.

Figure 9:
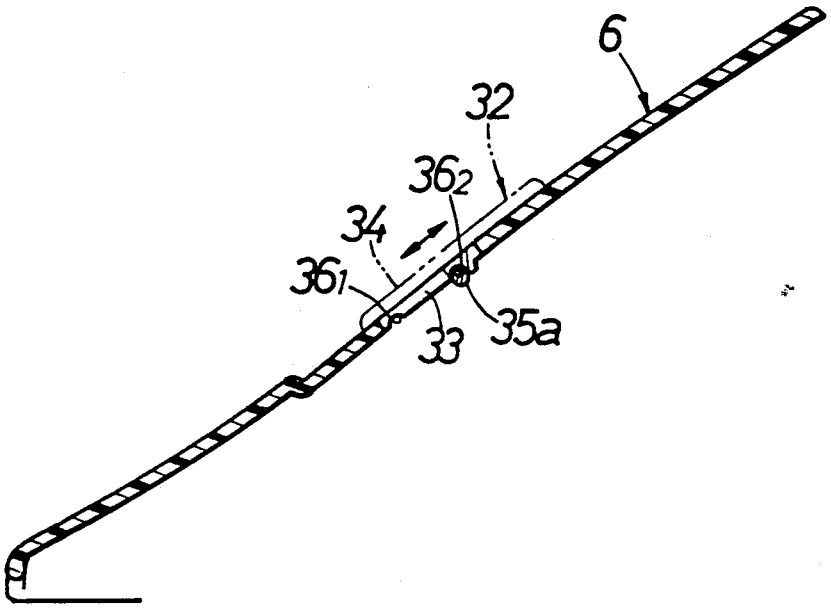
FIG. 9 is a sectional view taken along a line IX—IX in FIG. 1.

As clearly in FIGS. 3, 8 and 9, a first $36_1$ and a second recess $36_2$ are formed at a predetermined distance in the lower face of the outer edge of each elongated hole 33. If the folded end **35*a* of each support leg 35 is engaged into each first recess $36_1$ closer to the escape opening 31, the shutter 32 is located in its closed position in which the escape opening 31 is completely closed by the flat plate portion 34. If the folded end 35***a* is engaged into each second recess $36_2$, the shutter 32 is located in its opened position in which the escape opening 31 is completely opened.

The visor 6 has a guide hole 36 made therein between both the elongated holes 33 in parallel to the elongated holes 33. The shutter 32 has a longitudinally extending guide projection 37 formed thereon at a central portion of the lower surface of the flat plate portion 34 and slidably fitted in the guide hole 38 in the visor 6. The guide projection 37 and the guide hole 38 cooperate to permit a smooth opening and closing movement of the shutter 32.

In attaching the shutter 32 to the visor 6, the wider portion 33*a* of the elongated hole 33 is used to insert each support leg 35 through the corresponding elongated hole 33 by deflecting the flat plate portion 34 so that the two support legs 35 approach to each other.

In the above construction, if the escape opening 31 is closed by the shutter 32, much travelling wind is gathered into the travelling-wind flow-in space C by the entire visor 6, so that the pressure in the space C is increased. Hence, the flow rates of travelling wind introduced directly into the air intake hole 29 and travelling wind introduced into the air intake hole 29 through a path bent by the guide wall 30 become maximum. The travelling wind flowing past the air intake hole 29 is guided into the cap body 2 and serves to ventilate the interior of the cap body 2.

On the other hand, if the escape opening 31 is opened by the shutter, the travelling wind in the travelling-wind flow-in space C escapes through the escape opening 31 by drawing-out effect of the travelling wind flowing along the outer surface of the visor 6, so that the pressure in the space C is reduced. Therefore, the flow rate of wind into the air intake hole 29 is reduced and at the same time, the flapping action of the travelling wind on the visor 6 is reduced.

Such an opening and closing operation of the shutter 32 is conducted in the visor 6 and hence, the operability is good.

As clearly shown in FIG. 2, the cap body 2 is comprised of a shell 40 made of fiber-reinforced synthetic resion, a buffer liner 41 made of foamed polystylene fitted into the shell 40, a top pad 42 covering a ceiling surface of the buffer liner 41, and an air-permeable fit pad 43 covering the inner peripheral surface excluding the ceiling surface of the buffer liner 41 and the chin covering portion 4.

As clearly shown in FIG. 1, at left and right opposite sides thereof, the chin covering portion 4 is provided with a plurality of air intake ports 44 for introducing the travelling wind, and a screen 45 is mounted on an inner surface of the chin covering portion 4 to cover outlets of the air intake ports 44.

It will be understood that the helmet according to the present invention is not limited to the full-face type, thus includes a jet type.

What is claimed is:

1. A helmet comprising a cap body and a shield plate pivotally mounted at left and right opposite ends on the cap body for pivotal movement between a closed position in which an opening in a front face of the cap body is closed and opened position in which the opening in the front face is opened, wherein the helmet further includes a visor which is attached at left and right opposite ends thereof to the cap body, a tip end of the visor being located at a position forwardly above the opening, a housing chamber being defined between the visor and the cap body for receiving the shield plate when the shield plate is pivotally moved to the opened position, and a retaining means provided between laterally extending portions of said visor and said shield plate for retaining said plate in its housed state by establishing engagement between the shield plate and the visor while utilizing an elasticity of at least one said visor and said shield plate.

2. A helmet according to claim 1, wherein said visor and shield are made of synthetic resin and said retaining means is provided between laterally central portions of said visor and shield plate.

3. A helmet according to claim 1, wherein said housed-state retaining means comprises an engaging projection provided on an inner surface of the visor, and an engaging pawl provided on said shield plate and adapted to be engaged with said engaging projection after climbing across said engaging projection.

4. A helmet according to claim 1, 2 or 3, further including a closure retaining means provided between the cap body and the shield plate for retaining the shield plate at the closed position, said closure retaining means including a first engaging element mounted on the cap body for shifting in the longitudinal direction of the cap body, and a second engaging element mounted on the shield plate and adapted to be engaged with the first engaging element, wherein a fixing element is provided for fixing the first engaging element to said cap body at any position within a range of shifting of said first engaging element.

5. A helmet according to claim 1, 2 or 3, further including an adjusting means between said cap body and said visor for adjusting the mounting position of said visor in the longitudinal direction of said cap body, and a closure retaining means between said cap body and said shield plate for retaining said shield plate at the closed position, said adjusting means including a body located on an outer surface of said cap body for shifting in the longitudinal direction of the cap body, and provided with a stopper adapted to be engaged with said visor to restrain the movement of the visor in the longitudinal direction of the cap body, and a fixing element for fixing the body of the adjusting means to the cap body at any position within a region of shifting of said body, said closure retaining means including a first engaging element mounted on said body for shifting in the longitudinal direction of the cap body, and a second engaging element mounted on the shield plate and adapted to be engaged with the first engaging element, said first engaging element being fixed together with said adjusting means to said cap body at any position within a region of shifting of said first engaging element by said fixing element.

6. A helmet comprising a cap body and a shield plate pivotally mounted at left and right opposite ends thereof on the cap body for pivotal movement between a closed position in which an opening in a front face of the cap body is closed and an opened position in which the opening in the front face is opened, wherein the helmet further includes a visor which is attached at left and right opposite ends thereof to the cap body, and attached to and detachable from said cap body, a tip end of the visor being located at a position forwardly above the opening, a housing chamber being defined between the visor and the cap body for receiving the shield plate when the shield plate is pivotally moved to the opened position, and an adjusting means between said cap body and said visor for adjusting the mounting position of said visor in the longitudinal direction of said cap body, and a fixing element for fixing the body of the adjusting means to the cap body at any position within a region of shifting of the body, said body being provided with a stopper adapated to be engaged with the visor to restrain the movement of the visor in the longitudinal direction of said cap body.

7. A helmet comprising a cap body and a shield plate pivotally mounted at left and right opposite ends thereof on the cap body for pivotal movement between a closed position in which an opening in a front face of the cap body is closed and an opened position in which the opening in the front face is opened, wherein the helmet further includes a visor which is attached at the left and right opposite ends thereof to the cap body, a tip end of the visor being located at a position forwardly above the opening, a housing chamber being defined between the visor and the cap body for receiving the shield plate when the shield plate is pivotally moved to the opened position, and closure retaining means provided between the cap body and the shield plate for retaining the shield plate at the closed position, said closure retaining means including a first engaging element mounted on the cap body for shifting in the longitudinal direction of the cap body, and a second engaging element mounted on the shield plate and adapted to be engaged with the first engaging element, wherein a fixing element is provided for fixing the first engaging element to said cap body at any position within a region of shifting of said first engaging element.

8. A helmet comprising a cap body and a shield plate pivotally mounted at left and right opposite ends thereof on the cap body for pivotal movement between a closed position in which an opening in a front face of the cap body is closed and an opened position in which the opening in the front face is opened, wherein the helmet further includes a visor which is attached at left and right opposite ends thereof to the cap body, a tip end of the visor being located at a position forwardly above the opening, a housing chamber being defined between the visor and the cap body for receiving the shield plate when the shield plate is pivotally moved to the opened position, an adjusting means between said cap body and said visor adjusting the mounting position of said visor in the longitudinal direction of said cap body, and a closure retaining means between said cap body and said shield plate for retaining said shield plate at the closed position, said adjusting means including a body located on an outer surface of said cap body for shifting in the longitudinal direction of the cap body and provided with a stopper adapted to be engaged with said visor to restrain the movement of the visor in the longitudinal direction of the cap body, and a fixing element for fixing the body of the adjusting means to the cap body at any position within a region of shifting of said body, said closure retaining means including a first engaging element mounted on said body for shifting in the longitudinal direction of the cap body, and a second engaging element mounted on the shield plate and adapted to be engaged with the first engaging element, said first engaging element being fixed together with said body of said adjusting means to said cap body at any position within a region of shifting of said first engaging element by said fixing element.

* * * * *

UNITED STATES PATENT AND TRADEMARK OFFICE

CERTIFICATE OF CORRECTION

PATENT NO. : 5,157,794

DATED : Oct. 27, 1992

INVENTOR(S) : Kamata

It is certified that error appears in the above-indentified patent and that said Letters Patent is hereby corrected as shown below:

On the cover page, item [75] "Fitaro Kamata" should read --Eitaro Kamata--

Signed and Sealed this

Twenty-fourth Day of May, 1994

*Attest:*

Bruce Lehman

BRUCE LEHMAN

*Attesting Officer*

*Commissioner of Patents and Trademarks*